US007075232B2

(12) United States Patent
Maseki et al.

(10) Patent No.: US 7,075,232 B2
(45) Date of Patent: Jul. 11, 2006

(54) HIGH-PRESSURE DISCHARGE LAMP

(75) Inventors: Kyouichi Maseki, Saitama (JP); Makoto Okahara, Saitama (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 0 days.

(21) Appl. No.: 10/508,001

(22) PCT Filed: Sep. 6, 2002

(86) PCT No.: PCT/JP02/09118

§ 371 (c)(1),
(2), (4) Date: Feb. 8, 2005

(87) PCT Pub. No.: WO2004/027817

PCT Pub. Date: Apr. 1, 2004

(65) Prior Publication Data

US 2005/0127841 A1 Jun. 16, 2005

(51) Int. Cl.
*H01J 1/62* (2006.01)
*H01J 63/04* (2006.01)

(52) U.S. Cl. ..... 313/512; 313/234; 313/238

(58) Field of Classification Search ..... 313/234, 313/238

See application file for complete search history.

(56) References Cited

U.S. PATENT DOCUMENTS 3,911,308 A * 10/1975 Akutsu et al. ..... 313/567
4,232,243 A * 11/1980 Rigden ..... 313/623
4,929,863 A * 5/1990 Verbeek et al. ..... 313/113
5,905,341 A * 5/1999 Ikeuchi et al. ..... 313/639
6,060,830 A * 5/2000 Sugitani et al. ..... 313/639
2001/0038267 A1 11/2001 Ono et al. ..... 315/106

FOREIGN PATENT DOCUMENTS

JP 2001-312997 11/2001
JP 2001-325918 11/2001
JP 2002-83538 3/2002

OTHER PUBLICATIONS

English language Abstract of JP 2001-312997.
English language Abstract of JP 2001-325918.
English language Abstract of JP 2002-83538.

* cited by examiner

*Primary Examiner*—Don Wong
*Assistant Examiner*—Marie Antoinette Cabucos
(74) *Attorney, Agent, or Firm*—Greenblum & Bernstein, P.L.C.

(57) ABSTRACT

A high pressure discharge lamp according to the present invention is a high pressure discharge lamp in which the top ends of a pair of electrodes opposed in a discharge vessel 2 of an arc tube 1 are formed each into a substantially semispherical shape and a protrusion 10 to form an arc spot is formed at each top end, wherein all of the relation: $0.3 \cdot\cdot L/I \cdot\cdot 1.0$ for an inter-electrode distance L(mm) between the electrodes and a lamp current I(A) during stable lighting, the relation: $1.2 \cdot\cdot 10^{-7} \cdot\cdot X/Y \cdot\cdot 1.1 \cdot\cdot 10^{-5}$ for a molar amount X(mol) of bromine in the bromide sealed in the discharge vessel 2 and an inner volume Y(ml) of the discharge vessel 2, and the relation: $9 \cdot\cdot W^{3/2}/I \cdot\cdot 65$, for a weight W(mg) of tungsten at the top end of each electrode 3 formed into a substantially semispherical shape are satisfied, and the lighting frequency of a rectangular wave during stable lighting is 45 Hz or higher.

3 Claims, 2 Drawing Sheets

HIGH-PRESSURE DISCHARGE LAMP

This application is a 371 of PCT/JP02/009118 filed on Sep. 6, 2002.

TECHNICAL FIELD

The present invention concerns a high pressure discharge lamp having a pair of electrodes formed of tungsten opposed to each other in a discharge vessel of an arc tube in which mercury, a bromide and a rare gas are sealed and, particularly, it relates to a short arc type high pressure discharge lamp in which the top ends of both electrodes opposed to each other are formed each into a substantially semispherical shape and a protrusion to form an arc spot by discharge between the electrodes is formed at the top end.

BACKGROUND ART

Since a back light provided to a projection type image display device such as a projection type liquid crystal display or a liquid crystal projector is required to project images uniformly at a sufficient luminance, efficiency, and color rendition to a rectangular screen, a high pressure discharge lamp such as a high pressure mercury lamp or metal halide lamp is used as a light source.

Generally, in the lamp of this type, mercury as a light emitting substance, a halogen compound such as a bromide that performs the halogen cycle effect of returning tungsten evaporated from the electrodes and deposited to the inner surface of the discharge vessel to the electrodes thereby suppressing blacking of the arc tube, and a rare gas such as argon, krypton or xenon as an auxiliary gas for starting lighting are sealed in a discharge vessel of the arc tube in which a pair of electrodes comprising tungsten are opposed. In the short arc type high pressure discharge lamp with the inter-electrode distance being shortened in order to provide a high luminance light source approximate to a spot light source, since the temperature at the top end of the electrode increases excessively, it results in a problem of remarkable melting and evaporation of tungsten to deform or abrade the top end of the electrode, as well as early blackening of the arc tube by deposition of evaporated tungsten to the inner surface of the discharge vessel to shorten the lamp life.

Further, when the inter-electrode distance is shortened, it results in an arc jump phenomenon that an arc spot (region to which an electron current is emitted upon cathode operation of the electrode) formed in the initial lighting period of the lamp near the center at the top end of the electrode moves cyclically (on every lighting period) to a position different from the initial lighting period along with lapse of the lighting time and the screen illuminance of the protection type image display device is lowered as much as by about 30% during lighting only for about 100 hours, or unpleasant flicker is caused on the screen due to fluctuation of the luminance.

That is, in the high pressure discharge lamp used as a light source for the backlight of the projection type image display device, while optical axes are previously adjusted so as to align the tubular axis of the arc tube with the central axis of a concaved reflection mirror for reflecting the light emitted from the arc tube, when the arc jump phenomenon should occur, since the arc spot displaces from the optical axis and moves at random on every lighting period, this results in a problem of unpleasant flicker on the screen due to fluctuation of the luminance and lowering the screen illuminance.

In view of the problem described above, JP-A Nos. 2001-312997, 2001-325918, and 2002-83538 disclose techniques of diametrically enlarging the top end of the electrode to increase the heat capacity in order to suppress melting and evaporation of electrode-forming. tungsten, and forming the top end of the electrode into a substantially semispherical shape to form a region of generating the arc spot at a spherical convex surface in order to suppress the occurrence of the arc jump phenomenon.

Further, JP-A No. 2001-312997 discloses a technique of supplying AC current for a predetermined time between a pair of electrodes, each top end of which is formed into a substantially semispherical shape to generate arc discharge and previously forming a protrusion as an arc spot at each top end of both electrodes by the discharge thereby increasing the heat capacity at the top end of the electrodes and preventing the occurrence of the arc jump phenomenon.

However, according to the experiment and study on the function and the effect of this technique, it has been found that unless various conditions such as the lighting waveform or the lighting frequency of the lamp, the bromine concentration of the bromide sealed in the discharge vessel of the arc tube, the inter-electrode distance, the level of the lamp current, and the weight of tungsten at the top end of the electrodes each formed into the substantially semispherical shape are controlled properly, the protrusion as the arc spot formed at the top end of the electrode is eliminated only in several minutes from the start for the lighting of the lamp to cause early arc jump phenomenon, or the protrusion grows abnormally to shorten the inter-electrode distance thereby bringing about a disadvantage of lowering the lamp voltage in an early stage and lowering the illuminance and, further, that deformation or abrasion at the top end of the electrode and early blackening of the arc tube are caused.

In view of the above, the present invention intends to properly control the conditions described above in the high pressure discharge lamp, thereby preventing the deformation or abrasion at the top end of the electrode and early blackening of the arc tube and suppressing elimination and abnormal growth of the protrusion as the arc spot formed to the top end of the electrode to reliably prevent occurrence of the arc jump phenomenon and prevent flicker on the screen of the projection type image display device using a high pressure discharge lamp as a light source and prevent lowering of the screen illuminance.

DISCLOSURE OF THE INVENTION

The present invention provides a high pressure discharge lamp having a pair of electrodes formed of tungsten opposed in a discharge vessel of an arc tube in which mercury, a bromide and a rare gas are sealed, each of the top ends of both of the electrodes is formed into a substantially semispherical shape, and a protrusion to form an arc spot by discharge between the electrodes is formed at the top end thereof, wherein the conditions of the following formulae 1 to 3 are satisfied assuming the inter-electrode distance between both of the electrodes as L(mm), a lamp current during stable lighting as I(A), the molar amount of bromine in the bromide sealed in the discharge vessel of the arc tube as X(mol), the inner volume of the discharge vessel of the arc tube as Y(ml), and the weight of tungsten at the top end of each electrode formed into a substantially semispherical shape as W(mg):

$$0.3 \leqq L/I \leqq 1.0 \qquad \text{Formula 1:}$$

$$1.2\times10^{-7} \leqq X/Y \leqq 1.1\times10^{-5} \qquad \text{Formula 2:}$$

$$9 \leqq W^{3/2}/I \leqq 65 \qquad \text{Formula 3:}$$

In the high pressure discharge lamp according to the invention, since the top ends for the opposed electrodes are formed each into substantially a semispherical shape, a protrusion to form an arc spot is formed at the topmost portion of the electrode where the inter-electrode distance is shortest.

Then, according to experiment made by the present inventors, in a case where the value L/I is less than 0.3, since the top end of the electrode is abraded and the lamp voltage increases in an early stage, stable discharge can no more be obtained. On the other hand, when the value L/I exceeds 1.0, since tungsten is deposited and accumulated excessively due to the halogen cycle effect to the protrusion as the arc spot formed at the top end of the electrode, the inter-electrode distance is shortened to lower the lamp voltage in an early stage to lower the illuminance due to insufficiency of the lamp power. In a case where the value L/I is selected within a range from 0.3 to 1.0, abrasion at the top end of the electrode or abnormal growth of the protrusion to form the arc spot can be suppressed.

Further, in a case where the value X/Y is less than $2 \cdot\cdot 10^{-7}$, blackening of the arc tube proceeds in an early stage. On the other hand, when the value exceeds $1.1 \cdot\cdot 10^{-5}$, the basic portion of the electrode supporting the top end formed into the substantially semispherical shape is thinned in an early stage tending to cause dropping of the electrode. In a case where the value X/Y is selected within a range from $1.2 \cdot\cdot 10^{-7}$ to $1.1 \cdot\cdot 10^{-5}$, early blackening and electrode dropping of the arc tube can be prevented.

Further, in a case where the value $W^{3/2}/I$ is less than 9, the top end of the electrode is abraded in an early stage to result in abrupt increase of the lamp voltage. On the other hand, when the value exceeds 65, the starting performance of the lamp is worsened, and the protrusion as the arc spot formed at the top end of the electrode is degenerated or eliminated, or formed in plurality to possibly cause the arc jump phenomenon of displacing the arc spot. In a case where the value $W^{3/2}/I$ is selected within a range from 9 to 65, since the shape and the size of the protrusion do not change so much; there is no worry for the occurrence of the arc jump phenomenon and early abrasion at the top end of the electrode.

Further, in a case where the lamp is not lit by the rectangular wave, since the period of causing glow discharge between the electrodes is present, this blackens the arc tube. In a case where the lighting frequency in the stable lamp lighting is lower than 45 Hz, since the cooling time during the cathode operation of the electrode is long, the protrusion as the arc spot formed at the top end of the electrode grows abnormally to shorten the inter-electrode distance by which the lamp voltage lowers in an early stage to lower the illuminance due to insufficiency of the lamp power. In a case where the lamp is lit by the rectangular wave and the rectangular wave lighting frequency is set to 45 Hz or higher, it is possible to prevent early blackening of the arc tube and abnormal growth of the protrusion to form the arc spot.

Further, in the invention, the amount of mercury sealed in the discharge vessel of the arc tube is selected within a range from 130 to 290 mg per unit inner volume (ml) of the discharge vessel for enabling the size-reduction of a stabilizer, attaining high luminance, high efficiency and high color rendition of the lamp and preventing burst of the arc tube.

That is, when the inner pressure of the discharge vessel during lighting of a lamp is calculated according to the equation of state of gas assuming the average gas temperature in the discharge vessel of the arc tube as 2000 K, the inner pressure of the discharge vessel is at about 100 atm in view of calculation when the amount of mercury sealed in the discharge vessel of the arc tube is less than 130 mg/ml. However, since diatom molecules of mercury are present by about 8% in the vicinity of 100 atm, it is actually 100 atm or lower, so that the lamp voltage is lowered to require supply of larger lamp current making it difficult to reduce the size of the stabilizer. Further, at 100 atm or lower, radial divergence of the arc formed between the electrodes can be not suppressed sufficiently to result in an arc of large diameter and weak optical output and accordingly, even when the lamp and the concave surface reflection mirror are combined, neither high illuminance nor preferred color is obtained, so that high luminance, high efficiency and high color rendition can not be provided. On the other hand, in a case where the amount of mercury exceeds 290 mg/ml, the inner pressure of the discharge vessel during lamp lighting is theoretically about 240 atm and since it reaches substantially 200 atm or higher even considering the presence of diatom molecules of mercury by about 15% in the vicinity of 200 atm, the pressure proof strength is sometimes exceeded depending on the arc tube to bring about a danger of burst.

In view of the above, in the invention, the amount of mercury sealed in the discharge vessel of the arc tube is selected within a range from 130 to 290 mg/ml so as to define the inner pressure of the discharge vessel of the arc tube during lamp lighting within a range of 100 to 200 atm.

BEST MODE FOR PRATICING THE INVENTION

A best mode for practicing the present invention is to be described with reference to the accompanying drawings.

Figure 1:
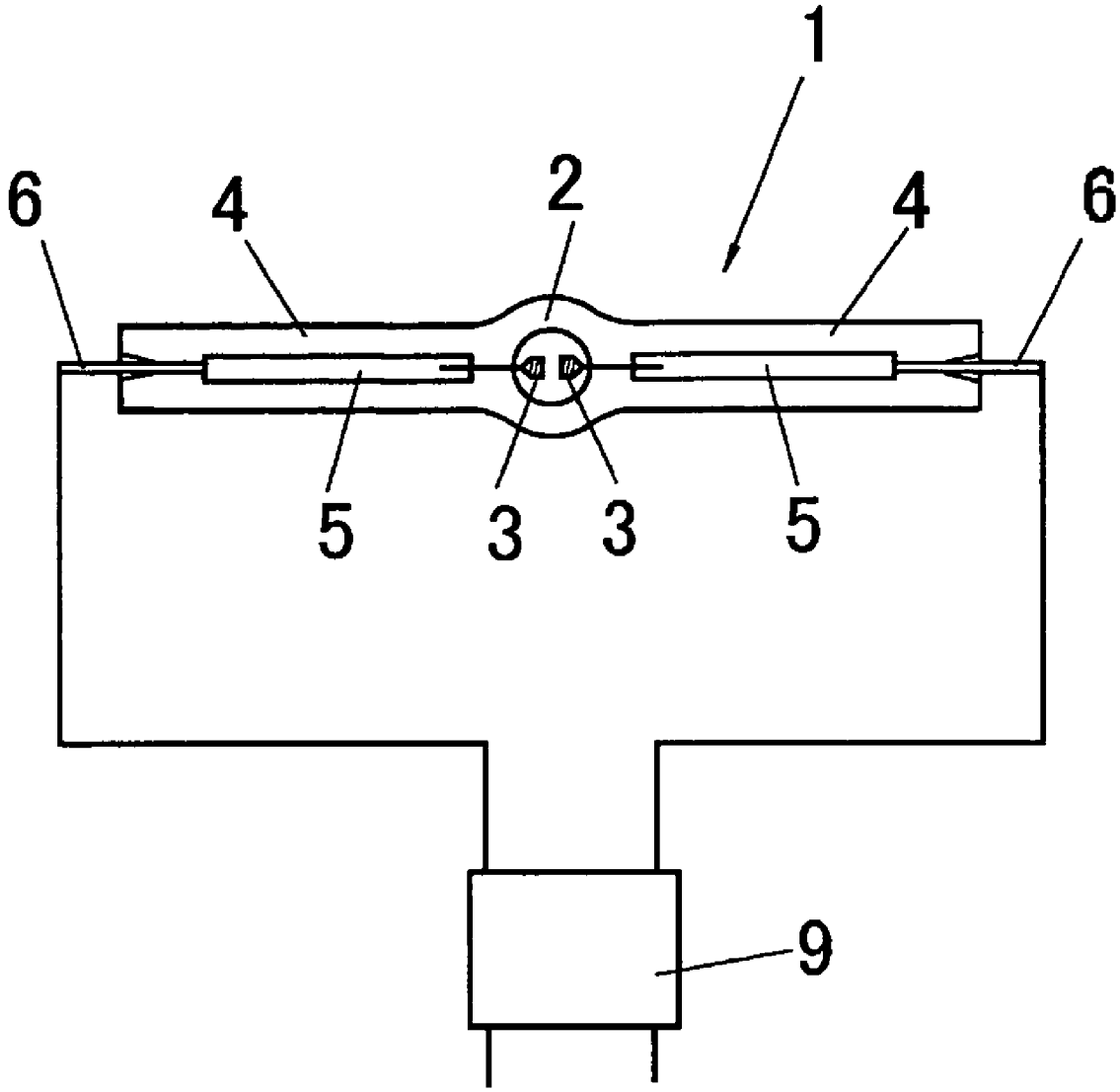
FIG. 1 is a view showing an example of a high pressure discharge lamp according to the present inventions.

A high pressure discharge lamp shown as an example in FIG. 1 is a high pressure mercury discharge lamp having a rated power of 120 W in which a pair of electrodes 3,3 each formed of tungsten are opposed in a discharge vessel 2 formed by spherically bulging a central portion of an arc tube 1, and mercury as a light emitting substance, hydrogen bromide as a halogen compound performing the halogen cycle function, and an argon gas as the rare gas that functions as an auxiliary gas for starting lighting are sealed.

The inner volume (Y) for the discharge vessel 2 of the arc tube 1 is selected to about 0.06 ml, the amount of mercury sealed in the discharge vessel 2 is selected to 13 mg (per unit inner volume: 213 mg/ml), the molar amount of bromine (X) of hydrogen bromide is selected to $3.0 \cdot\cdot 10^{-7}$ mol/ml and the amount of the argon gas sealed is selected to $1.6 \cdot\cdot 10^{4}$ Pa (at normal temperature), respectively.

The arc tube 1 is made of molten quartz and the discharge vessel 2 thereof is formed to 9.4 mm of maximum outer diameter and 4.8 mm of maximum inner diameter. On both ends of the discharge vessel 2 in which electrodes 3,3 are buried and secured, sealing portions 4, 4 for air tightly sealing both ends are formed.

In the sealing portions 4, 4, are buried a base part of each electrode 3, a molybdenum foil 5 of 20 mm length connected to each base part and a molybdenum wire 6 of 0.5 mm diameter connected with the molybdenum foil 5.

Figure 2A:
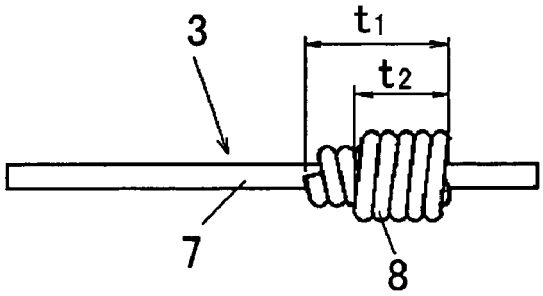
FIGS. 2(*a*) and 2(*b*) are views showing the shape after fabrication and the shape before fabrication of an electrode used for a high pressure discharge lamp according to the invention.
Figure 2B:
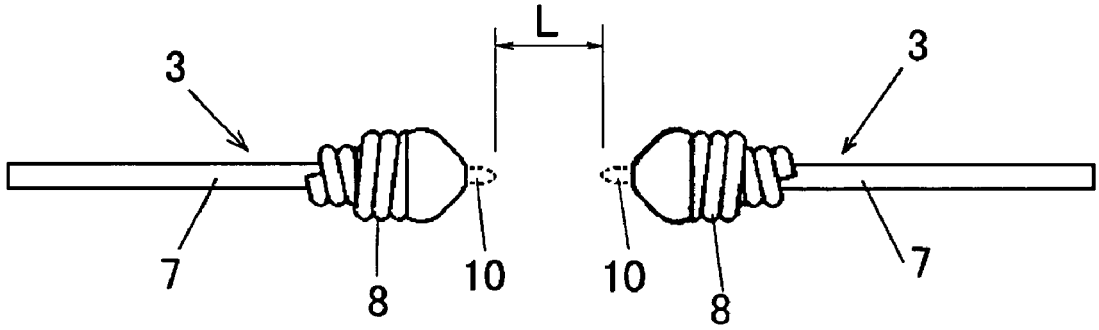

In each of the electrodes 3, at first as shown in FIG. 2(*a*), a coil 8 of 0.22 mm outer diameter formed of tungsten at high purity is closely wound by 7 turns around the top end of an electrode bar 7 of 0.3 mm outer diameter and 7.0 mm length formed of tungsten at high purity from the rear end to the top end so as to expose the top end of the electrode bar 7 by 1 mm, and then further closely wound around by 5 turns from the top end to the rear end so as to be wound under overlap continuously thereover into a double-wound coil state having an inner wound portion t1 and an outer wound portion t2. Then, the top end of the electrode bar 7 for each of the electrodes 3 is applied with heat melting by arc plasma, laser, or electron beam by which top end and a portion of the coil 8 are heat melted up to a position leaving the outer wound portion t2 of the coil 8 by about 2 to 3 turns. As shown in FIG. 2(*b*), the top end for each electrode 3 is formed into a substantially semispherical shape by the surface tension phenomenon of the molten portion tending to take a spherical shape, and the substantially semispherical top end for each electrode 3 is fabricated so as to have a bulky specific gravity of 93% or more than the theoretical density (19.3) of tungsten, that is, a density of 18.0 or more.

By the fabrication, the entire length for each electrode 3 is about 6.7 mm and the weight of tungsten (W) at the substantially semispherical portion at the top end is about 10 mg.

Then, the pair of electrodes 3, 3 thus fabricated are opposed in the discharge vessel 2 of the arc tube 1 and secured to the sealing portions 4, 4. Then, when electric current is supplied to the lamp by a rectangular waveform electron stabilizer 9 at a rectangular wave frequency of 150 Hz under the condition at 120 W of lamp power, 90 V of lamp voltage, with about 1.3A of lamp current (I) with the arc tube 1 being placed in a horizontal state to light up for about 2 hours while preserving the temperature such that the outer lower surface temperature of the discharge vessel 2 of the arc tube 1 is from 850 to 900° C., tungsten is accumulated at the tip of the top end of each electrode 3 where the discharging arc is generated by discharge between electrodes 3 and 3 to form a protrusion 10 with the largest diameter of about 0.015 mm and a length of about 0.1 mm as shown by the broken line in FIG. 2(*b*). The protrusion 10 forms an arc spot.

Further, it is designed such that the inter-electrode distance (L) is finally about 1.0 mm by the formation of the protrusion 10 at the top end of each electrode 3.

In the thus completed high pressure discharge lamp, even after lapse of the lighting time for about several thousand hours, the protrusions 10 formed at the top ends of the electrodes 3, 3 are not degenerated or eliminated or do not grow abnormally and the shape and the length of the protrusion 10 is kept substantially constant. Accordingly, there is no worry that the arc spot moves at random to cause the arc jump phenomenon, as well as that the inner-electrode distance is shortened to lower the lamp voltage in an early stage.

Accordingly, when the lamp is used as a light source for the projection type image display device, it can reliably overcome the disadvantage of causing flickering on the screen or lowering of the screen illuminance caused by the arc jump phenomenon.

INDUSTRIAL APPLICABILITY

As has been described above, in the high pressure mercury lamp according to the present invention, since there is no worry of causing the arc jump phenomenon in which the arc spot as a portion irradiated with the electron current during cathode operation of the electrode moves cyclically, it can provide high usefulness as a light source for a back light provided to a projection type image display device such as a projection type liquid crystal display or a liquid crystal projector.

The invention claimed is:

1. A high pressure discharge lamp having a pair of electrodes formed of tungsten opposed in a discharge vessel of an arc tube in which mercury, a bromide and a rare gas are sealed, each of the top ends of the electrodes is formed into a substantially semispherical shape, and a protrusion to form an arc spot by the discharge between the electrodes is formed at the top end thereof, wherein the conditions of the following formulae 1 to 3 are satisfied when assuming, an inter-electrode distance between both of the electrodes as L(mm), a lamp current during stable lighting as I(A), a molar amount of bromine in the bromide sealed in the discharge vessel of the arc tube as X(mol), an inner volume of the discharge vessel of the arc tube as Y(ml), and a weight of tungsten at the top end of each electrode formed into a substantially semispherical shape as W(mg):

$$0.3 \leqq L/I \leqq 1.0 \quad \text{Formula 1:}$$

$$1.2\times10^{-7} \leqq X/Y \leqq 1.1\times10^{-5} \quad \text{Formula 2:}$$

$$9 \leqq W^{3/2}/I \leqq 65 \quad \text{Formula 3.}$$

2. A high pressure discharge lamp according to claim 1, wherein the amount of mercury sealed in the discharge vessel of the arc tube is from 130 to 290 mg per unit inner volume (ml) of the discharge vessel.

3. A high pressure discharge lamp according to claim 1, wherein the lighting frequency of a rectangular wave during stable lighting is 45 HZ or higher.

* * * * *